United States Patent [19]

Mothe

[11] Patent Number: 4,998,843

[45] Date of Patent: Mar. 12, 1991

[54] MODULAR ANTI-INTRUSION BARRIER

[76] Inventor: Gérard Mothe, 146 rue Stéhélin, 33200 Bordeaux, France

[21] Appl. No.: 517,477

[22] Filed: Apr. 24, 1990

Related U.S. Application Data

[63] Continuation of Ser. No. 229,168, Jul. 5, 1988, abandoned.

[30] Foreign Application Priority Data

Nov. 4, 1986 [FR] France ..... 86 15444

[51] Int. Cl.[5] ..... E01F 13/00; E01F 15/00

[52] U.S. Cl. ..... 404/6; 404/11; 404/33

[58] Field of Search ..... 404/6, 9, 11; 49/33, 49/49, 131-134

[56] References Cited

U.S. PATENT DOCUMENTS

| | | | |
|---|---|---|---|
| 1,531,987 | 3/1925 | Smith | 49/33 X |
| 1,579,125 | 3/1926 | Marshall et al. | 49/33 |
| 1,734,228 | 11/1929 | Page | 404/11 X |
| 2,175,636 | 10/1939 | Morgan | 49/134 |
| 2,528,790 | 11/1950 | Scherer | 49/33 X |
| 2,627,920 | 2/1953 | Barlow | 49/49 X |
| 2,735,202 | 2/1956 | King | 49/33 X |
| 4,318,079 | 3/1982 | Dickinson | 404/6 |
| 4,354,771 | 10/1982 | Dickinson | 404/6 |
| 4,367,975 | 1/1983 | Tyers | 404/6 |
| 4,554,695 | 11/1985 | Rowland | 404/6 |
| 4,576,507 | 3/1986 | Terio | 404/6 |
| 4,576,509 | 3/1986 | Beaty, Sr. | 404/6 |
| 4,577,991 | 3/1986 | Rolow | 404/6 |
| 4,630,395 | 12/1986 | Nasatka | 49/49 |
| 4,669,912 | 6/1987 | Truglio | 404/6 |
| 4,775,261 | 10/1988 | Fladung | 404/6 |

FOREIGN PATENT DOCUMENTS

| | | |
|---|---|---|
| 8605666.2 | 4/1986 | Fed. Rep. of Germany . |
| 1102070 | 10/1955 | France . |
| 2166237 | 8/1973 | France . |
| 2586127 | 2/1987 | France . |
| 8204614 | 6/1984 | Netherlands . |
| 2032983 | 5/1980 | United Kingdom . |

*Primary Examiner*—Ramon S. Britts
*Assistant Examiner*—Gay Ann Spahn
*Attorney, Agent, or Firm*—Foley & Lardner, Schwartz, Jeffery, Schwaab, Mack, Blumenthal & Evans

[57] ABSTRACT

Device prohibiting access of alien vehicles to given zones, while allowing recognized, identified and authorized vehicles to enter, consisting of at least one re-usable modular element with instantaneous positioning which requires no specific installation, comprising an access-control barrier (13) activated by the help of the lever (14) of a release mechanism (9) (11) (17) (18), operable by a lever (11) and by a stop-barrier (2), which is released by the action of a skid (16) on a skid (9) pushing a bolt (7), the whole being incorporated in a frame (1).

10 Claims, 1 Drawing Sheet

MODULAR ANTI-INTRUSION BARRIER

This application is a continuation of application Ser. No. 07/229,168, filed Jul. 5, 1988, now abandoned.

The present invention concerns a modular anti-intrusion barrier, designed to authorize or prohibit access of land vehicles to a given zone.

It provides impenetrable reinforcemnt of accesses already existing or to be created, without any particular installation.

It is simply placed on the ground—possibly fixed into the ground, if the characteristics of vehicles likely to cross it renders this necessary.

Its thinness does not constitute an obstruction for vehicles crossing it, but works towards their slowing down, in the case of authorised entrance.

It consists of modular elements which can easily be placed side by side and assembled according to the dimension of the access to be protected—these modular elements being linked to each other by the controls of manoeuvering devices.

The monitoring of access to given zones is, at present, carried out by different systems:

Articulated raising-arm barriers on a horizontal axis

Portals with one or more pivoting flaps on a vertical axis

Sliding portals, etc.

In order to be more efficient, these control barriers are supplemented by the following types of barriers: portcullises, stop-barriers, pits, etc., which, for their installation, require considerable civil engineering work, and energy supply to put them into operation and the intervention of security guards where intruding vehicles are concerned.

Furthermore, these systems' reaction time is slow, which reduces their actual efficacy.

The conception of the modular anti-intrusion barrier reduces to a minimum reaction time in the event of intruding vehicles (about 1/10 second), using the energy of the intruding vehicle, without the inter-vention of security guards.

Once loaded, the modular anti-intrusion barrier (comprising, in a single body, both the access-control barrier and the stop-barrier, connected to each other by a release mechanism, which liberates energy stored in high-power springs which activate the stop-barrier), enables an extremely high-powered instantaneous action.

It is made up of a thin mechano-welded, resistant frame (1), on which the vehicles gaining access to the device enter by the means of ramps from right to left as shown in the figures.

On this frame (1) a metal portcullis or stop element (2) with two or more arms is articulated about an axis (3).

The arms are spaced-out and connected to each other like those of a rake by a wooden support.

Figure 1:
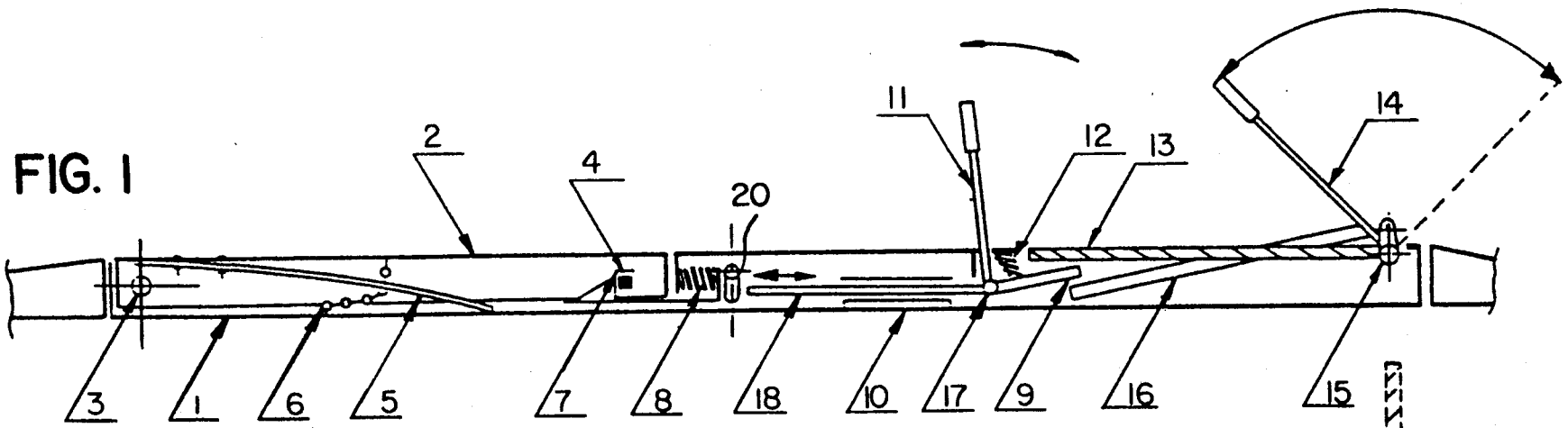
FIG. 1 is a side view of an anti-intrusion barrier constructed in accordance with a preferred embodiment of the invention with the anti-intrusion barrier being placed in a first operational position.
Figure 2:
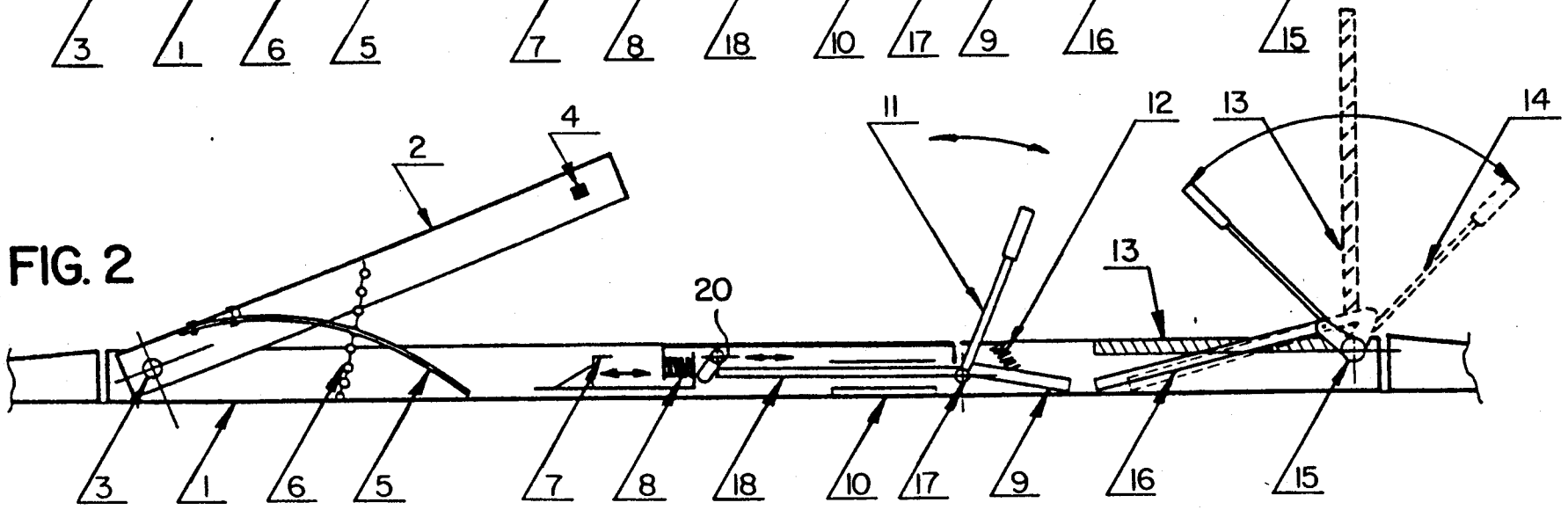
FIG. 2 illustrates the anti-intrusion barrier of FIG. 1 in a second operational position.

A notch (4), machined into the arms of the portcullis, keeps them in the horizontal position as shown in FIG. 1, under the action of a bolt (7) thereby opposing the action of a compressed spring (5) (a leaf spring in the shown embodiment) which is inclined to push the portcullis (2) toward a vertical position, as shown in FIG. 2. An adjustable stop (6) limits the raising of the portcullis (2) to the desired angle.

The bolt (7) is subject to a pressure of the spring (8) against the frame (1) and is thus pushed in a left to right direction in the figures well into the notch (4). The end oppostie the bolt (7) pushes against a lever (20) thereby to push back the articulation of a skid (9), which is stopped inside a sliding guide device (10) by the means of a button or pusher (18).

This skid (9) is articulated about an axis (17), can be run into the sliding guide device (10) which may be mounted on the frame (1), and is subject to a action of the spring (12), which has a tendency to slope downwards.

The movements of the skid (9) are controlled by the operator with the help of the manoeuvering lever (11), brought back into position by the spring (12) (FIG. 2).

The assembly comprising elements (9) (11) (12) (17) is called a release mechanism.

The manoeuvering lever (14) positions a control barrier (13) vertically or horizontally, authorizing or prohibiting the passage of vehicles, carrying along in its movement and articulated about the axis (15) a skid (16) which slides along the base of the frame (1) and can come into contact with a front portion of the skid (9) when this skid is in a position of rest under the action of the spring (12) (FIG. 2), without the intervention of the security guard.

The operation of the device is as follows:

The operator has at his disposal the lever (14) of the control barrier and the lever (11) of the release mechanism.

The barrier (13) is at rest, in a vertical position.

LOADING OF THE SYSTEM

The control barrier (13) is in a vertical position of rest by means of the lever (14). By vertical action on the metal portcullis (2), the spring (5) is at this point restricted by the engagement of the bolt (7) in the notch (4)—the system is then loaded. The metal portcullis (2) is horizontally flush with the frame (1) and bolted by the bolt (7).

The security guard can then proceed to the control access by using the levers (11) and (14).

MONITORING: AUTHORIZED VEHICLE

The control barrier (13) is in a vertical position by the action of the security guard on the lever (14): access is prohibited.

If the passage of the vehicle is authorized, the operator first works the lever (11) which raises the skid (9), neutralising contact with the skid (16), then lets down the control barrier (13) by action on the lever (14) as shown in FIG. 1.

Nothing then inhibits the passage of the vehicle.

ALIEN VEHICLE—PASSAGE OF VEHICLE UNAUTHROIZED

The barrier (13) is once again in a vertical position.

There is no action on the part of the operator.

In the case of unauthorized clearing, the falling down of the control barrier (13) by the intruding vehicle brings about the compression of the skid (9) due to the abutment of the skid (16).

The skid (9) moves the button or pusher (18) acting on the bolt (7) through the lever (20), liberates the portcullis (2), which has a tendency to move into a vertical position under the action of the spring (5), but is limited in its raising by the stop (6). This is accomplished by bringing about a horizontal displacement of the release mechanism (11) (9) (17) (18) under the action of the skid (16) pushing against the skid (9). The portcullis (2) which is now in the position shown in FIG. 2, then efficiently prohibits the passage of the intruding vehicle.

I claim:

1. Modular anti-intrusion barrier, comprising a single body which is, at one and the same time, an access-control barrier and a stop-barrier, linked to each other by a release mechanism, which activates the stop-barrier allowing, once loaded, an instantaneous, extremely high-powered action, and by the fact that it is placed on the ground wherein the loading of the modular anti-intrusion barrier is assured by the lowering of the stop-barrier, which tightens the spring, and by the fact that the stop-barrier is maintained flush by a bolt, the movement of the control barrier into a vertical position being obtained by activating a manoeuvering lever operatively connected only with said control barrier.

2. A modular anti-intrusion barrier for preventing unauthorized entry of a vehicle, comprising:

a frame;

a control barrier means movable from a first horizontal position through a second vertical position;

means for preventing vehicle entry movable from a first deactivated position to a second activated position;

means operatively connecting said control barrier means to said preventing means for actuating said preventing means;

said actuating means being operable in response to contact energy of a vehicle against said control barrier means.

3. The modular anti-intrusion barrier according to claim 2, further comprising means for moving said control barrier means from said first position through said second position.

4. The modular anti-intrusion barrier according to claim 3, further comprising means for retaining said control barrier means in said first position.

5. The modular anti-intrusion barrier according to claim 3, further comprising means for retaining said preventing means in said first position.

6. The modular anti-intrusion barrier for preventing unauthorized entry of a vehicle, comprising:

a frame;

a control barrier means movable from a first horizontal position through a second vertical position;

means for preventing vehicle entry movable from a first deactivated position to a second activated position;

means operatively connecting said control barrier means to said preventing means for actuating said preventing means;

said actuating means being operable in response to contact energy of a vehicle against said control barrier means;

said control barrier means being rotatable about a horizontal axis and including a first skid member eccentrically mounted about said horizontal axis and slidable on said frame; and said actuating means including a second skid member rotatable about a second horizontal axis from a first position, in which the second skid member is abuttable by the first skid member, and a second position thereby defining a clearance between said second skid member and said first skid member.

7. The modular anti-intrusion barrier according to claim 6, wherein said actuating means further comprises means for moving said second skid member from said first position to said second position.

8. The modular anti-intrusion barrier according to claim 6, wherein:

said actuating means includes a horizontally movable pusher member;

a lever means rotatable upon contact with said pusher member; and means for retaining said preventing means, said retaining means being moveable by said pusher member through said lever member.

9. The modular anti-intrusion barrier according to claim 7, further comprising means for urging said preventing means from said first position to said second position.

10. The modular anti-intrusion barrier according to claim 8, further comprising means for limiting the movement of said preventing means.

* * * * *